US007805829B2

(12) United States Patent
Herrmann et al.

(10) Patent No.: US 7,805,829 B2
(45) Date of Patent: Oct. 5, 2010

(54) APPARATUS FOR FIXING RIVETS IN STRUCTURAL PARTS

(75) Inventors: Guenter Herrmann, Guetersloh (DE); Oswin Moessner, Beelen (DE)

(73) Assignee: CLAAS Fertigungstechnik GmbH, Beelen (DE)

( * ) Notice: Subject to any disclaimer, the term of this patent is extended or adjusted under 35 U.S.C. 154(b) by 1268 days.

(21) Appl. No.: 11/037,358

(22) Filed: Jan. 18, 2005

(65) Prior Publication Data

US 2005/0172481 A1 Aug. 11, 2005

(30) Foreign Application Priority Data

Feb. 5, 2004 (DE) ..... 10 2004 005 859

(51) Int. Cl.
*B23P 11/00* (2006.01)

(52) U.S. Cl. ..... 29/715; 29/524.1; 29/525.06; 29/243.53; 227/51

(58) Field of Classification Search ..... 29/524.1, 29/525.06, 715, 243.53; 227/51, 55, 56, 227/58, 61, 62
See application file for complete search history.

(56) References Cited

U.S. PATENT DOCUMENTS 4,712,718 A * 12/1987 Yoshieda ..... 227/62
5,280,673 A 1/1994 Zieve et al.
5,774,968 A * 7/1998 Givler ..... 29/243.54
6,014,804 A * 1/2000 Lulay et al. ..... 29/715
6,088,897 A * 7/2000 Banks et al. ..... 29/243.53
6,457,624 B1 * 10/2002 Weihrauch ..... 227/10
7,082,663 B2 * 8/2006 Blocher et al. ..... 29/407.05
7,673,377 B2 * 3/2010 Clew ..... 29/407.1

FOREIGN PATENT DOCUMENTS

| | | |
|---|---|---|
| DE | 43 05 406 A | 8/1993 |
| DE | 44 04 095 A1 | 8/1995 |
| EP | 0 411 249 A1 | 2/1991 |
| WO | 99/29472 | 6/1999 |

* cited by examiner

*Primary Examiner*—David P Bryant
*Assistant Examiner*—Christopher M Koehler
(74) *Attorney, Agent, or Firm*—Michael J. Striker

(57) ABSTRACT

The apparatus for fixing rivets (4) in structural parts (11) includes a positioning adapter (3) for fixing one end of a rivet in a structural component with the rivet (4) in a riveting position; a riveting adapter (5) for deforming another end of the rivet, which has a movable deforming device (34) for deforming the rivet by impact energy stored in it; and a device for changing or adjusting the impact energy (33) stored in the movable deforming device. A greater flexibility for adjustment of the required impact energy (33) to different boundary conditions is thus possible, which guarantees that a minimal number of working strokes or only a single working stroke is required to fasten a rivet (4) in a structural component (11). This reduces the mechanical stress on the riveting adapter (5) and the working robot (6) guiding it besides reducing the noise level.

21 Claims, 4 Drawing Sheets

APPARATUS FOR FIXING RIVETS IN STRUCTURAL PARTS

BACKGROUND OF THE INVENTION

The present invention relates to an apparatus for fixing rivets in structural components, which has a positioning adapter for fixing one end of a rivet in a riveting position in a structural component, a riveting adapter for deforming the other end of the rivet, which has a movable deforming device for deforming the rivet by means of impact energy stored in it.

According to the state of the art there are very many different mechanisms for insertion and fixing fastening elements, such as rivets, in a structural part. Thus, for example, DE 43 05 406 A1 discloses a so-called screw insertion and flattening system whose driving device inserting the respective fastening element in the structural part can be moved back and forth in horizontal guidance. The driving device thus should be designed so that the fastening elements can be reliably inserted in the hole in the structural part while maintaining a predefined press fit and can then be deformed. For this purpose a system is used, in which a very great eddy current is produced in a short time, which accelerates the driving device carrying the fastening element to be inserted into the structural part so that the fastening element is reliably inserted in the structural part. However this sort of apparatus has the disadvantage that very great stresses are put on the mounting system, which are frequently beyond the forces required for reliable insertion of the fastening element in the structural part. This has the result that either the service life is considerably limited or these stresses must be handled by over-dimensioning of parts.

Also so-called rivet hammer and rivet tongs are widely used for inserting and fixing fastening elements, such as rivets, in component parts. This sort of system is generally driven by pressurized air. The moving deforming or connecting device introducing the fastening element into the component part and fixing it in it is engaged with the fasting element until it has achieved the desired fixed or fastened position. Besides the inaccuracy of the assembly due to repeated contacts on one and the same fastening element, especially this sort of system has the disadvantage that it generates loud noise.

SUMMARY OF THE INVENTION

It is an object of the present invention to provide an apparatus for attaching structural components to each other, which permits precise and quiet connection of the structural components to each other.

This object and others, which will be made more apparent hereinafter, are attained in an apparatus for fixing rivets in structural components, which comprises a positioning adapter for fixing one end of a rivet in a structural component with the rivet in a riveting position and a riveting adapter for deforming another end of the rivet, which has a movable deforming device for deforming the rivet by means of impact energy stored in it.

According to the invention the apparatus includes means for changing or adjusting impact energy of the movable deforming device on the rivet.

Since the impact energy of the movable deforming device is changeable, great flexibility in adjustment of the obtainable impact energy to different boundary conditions is possible, which guarantees that a reduction in the working strokes is obtained; in the best case only a single working stroke is required for deformation of the rivet in the structural components to be connected. Above all, this reduces the mechanical stresses on the riveting adapter and the working robot guiding it, besides reducing operating noise.

In the simplest case the impact energy can be influenced by the following parameters: acceleration of the movable deforming device and the length of the acceleration path of this deforming device or its mass. Only one or all of these parameters should be considered, depending on the desired adjustment flexibility. Because these parameters are changeable in a simple manner, the adjustment of the impact energy of the movable deforming device is not complicated.

An especially advantageous embodiment of the invention results when the impact energies are determined according to the specific properties of the rivet element and/or the position of the riveting adapter in space, since these parameters immediately influence the required values of the deforming energy and thus the impact energy to be generated.

When the movable deforming device is arranged horizontally movable within the riveting adapter, precise acceleration of a definite deforming mass is possible in a structurally simple manner, so that the impact energy is precisely adjusted. Based in part on the very high acceleration it is of special interest to guarantee as compact as possible a shape for the deforming device or mass element to be accelerated. This is achieved in a simple manner when the deforming device comprises an additional weight, a ram deforming the rivet associated with it and at least one carriage movable horizontally on which the latter elements are mounted.

So that recoil and thus repeated impacts of the ram on the rivet are avoided after a first contact of the ram with the rivet, the riveting adapter has a clamping unit, which causes a definite delay of the linear motion of the deforming device after it traverses the acceleration path and also brakes the motion of the movable deforming device after contact with the rivet. The braking of the linear guidance device and the movable deforming device can occur as simply as possible by pneumatic clamping means.

So that a precise position of the movable deforming device for setting a definite path over which the deforming device is accelerated is possible, the deforming device is driven by electrically driven linear motors in the horizontal direction within the riveting adapter in a preferred embodiment of the invention.

A simple adjustment of the length of the acceleration path is then possible when a linear guide system is associated with the movable deforming device, whose displacement measuring system is formed by a ruler or scale detectable by means of a sensor. The ruler or scale in the simplest case is directly integrated in the guide rails for the movable deforming device.

Because the horizontal component of the force of gravity acting on the deforming device acts either in or against the direction of the rivet according to the orientation of the riveting adapter, a precise adjustment of the impact energy requires information regarding the momentary orientation of the riveting adapter. In the simplest case this sort of information can be obtained when a position sensor constructed as an inclination sensor is mounted on the riveting adapter or on a segment of the working robot on which the riveting adapter is mounted.

Because of the complex relationship between the parameters influencing the impact energy it is appropriate to provided a control and processing unit for the riveting adapter, in which an editable executable computational algorithm or algorithms are stored, which determine the required value of the impact energy and the variables of the individual parameters, such as the mass of the movable deforming device, its acceleration and the length of the path over which the acceleration takes place.

In an advantageous further embodiment of the invention the control and processing unit is thus constructed so that the output signals generated in it cause the adjustment of the various parameters in the riveting adapter under consideration of different input data.

For improved monitoring of the running process the control and processing unit can have an associated display monitor so that the operator of the riveting station can visually display the various input data for the system as well as the calculated output data.

It is also advantageous when the riveting adapter is formed as end effecter of a working robot, so that it can be integrated in an existing production line without problems.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
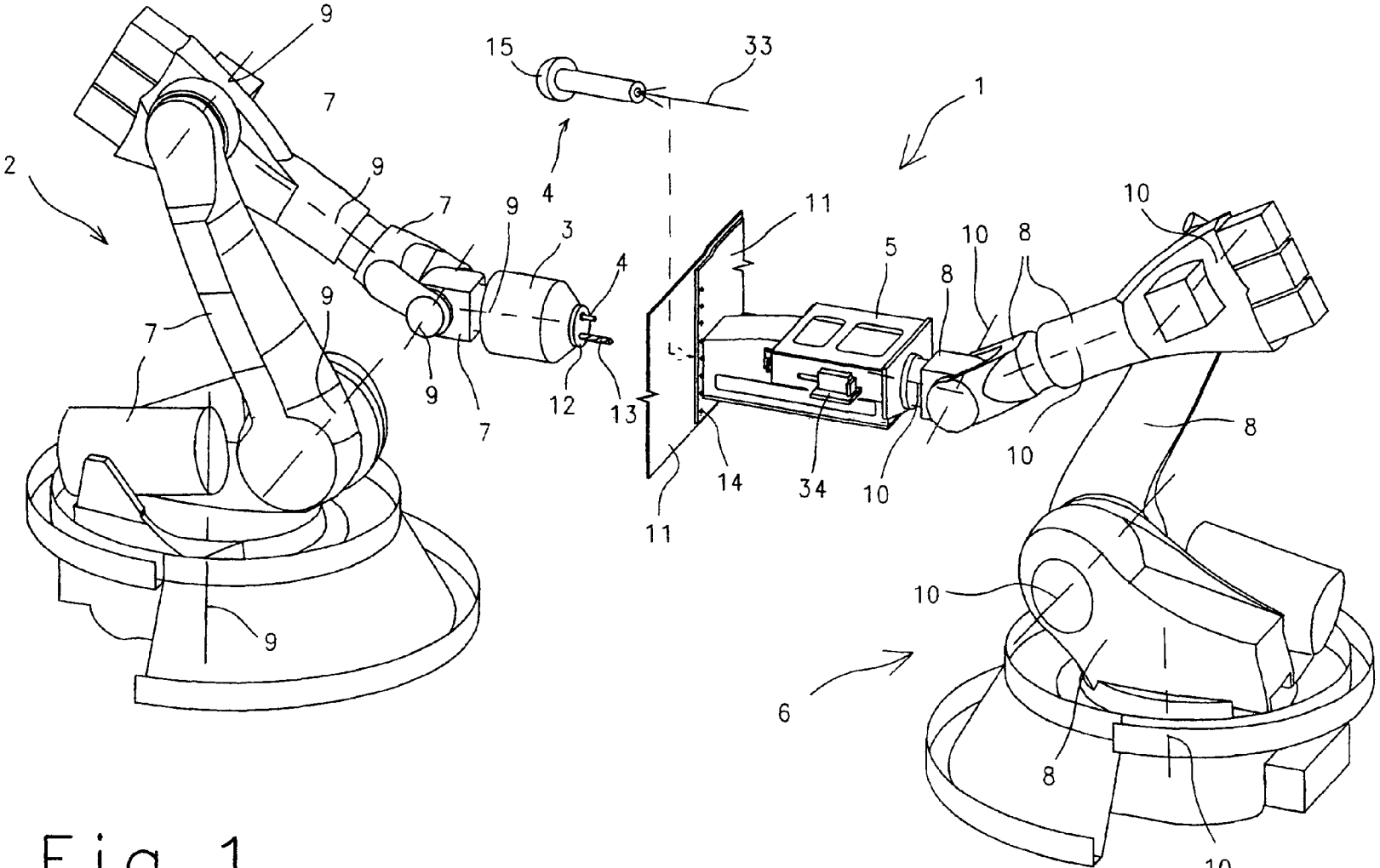
FIG. 1 is a perspective view of the riveting station according to the invention.

FIG. 1 shows a riveting station 1, which comprises a first working robot 2 with a pivoting positioning adapter 3 for preferably rivets 4 and an additional working robot 6 for guiding the riveting adapter 5 according to the invention. In a known manner the segments 7, 8 of the working robots 2, 6 pivot arbitrarily on pivot axes 9, 10 through space, so that the positioning adapter 3 and the riveting adapter 5 guided by the respective working robots 2, 6 can take arbitrary positions within the working areas of the working robots 2, 6. The working areas of both working robots 2, 6 are adjusted relative to each other, so that they can cooperate at least in part of the regions covered by their action radii. The structural components 11 to be connected together are arranged in these regions in the riveting station 1, so that the positioning adapter 3 and the riveting adapter can work together to insert and fasten the rivet 4 in the structural components 11 to be attached to each other.

The positioning adapter 3 arranged to pivot on the front end of the segment 7 of the first working robot 2 can be constructed in a way that is known and not described in further detail, so that a front end of the adapter unit 12 can hold or mount both the tool 13 for working or making holes 14 in the components 11 to be connected and also the rivets 4 for fastening the components 11 to each other. Usually the adapter unit 12 is provided with suitable tool and connecting element storage (not shown), from which different tools 13 are taken and returned to it and various quite different rivets 4 can be supplied to the adapter unit 12. In the illustrated embodiment a rivet 4 would be conveyed to the adapter unit 12 of the positioning adapter 3, which would insert it into one of the holes 14 through the structural components 11 to be connected by pivoting the segment 7 of the working robot 2, so that the head 15 of the rivet 4 is flush with structural component 11 facing the positioning adapter 3. In other embodiments the adapter unit 12 can have or mount several rivets 4 simultaneously, so that several rivets 4 can be inserted in appropriate holes 14 at the same time and can be fixed in position. Furthermore it is also conceivable that the segment 7 of the working robot 2 on which the positioning adapter 3 is mounted in its working position are fixed in position and only the adapter unit 12 is movable, for example, horizontally, so that first the tool 13 can make or work on the hole 14 and then the rivet 4 can be inserted in it.

If one or more rivets 4 are inserted in the components 11 to be connected by means of the adapter unit 12 of the positioning adapter 3, in the next step according to the invention and in a manner still to be described in more detail the rivet 4 is deformed and thus the components 11 are fastened together. The riveting adapter 5 is guided by pivoting the segment 8 of the working robot 6 carrying the riveting adapter 5 about the respective pivot axes 10 toward the respective rivet 4.

Figure 2:
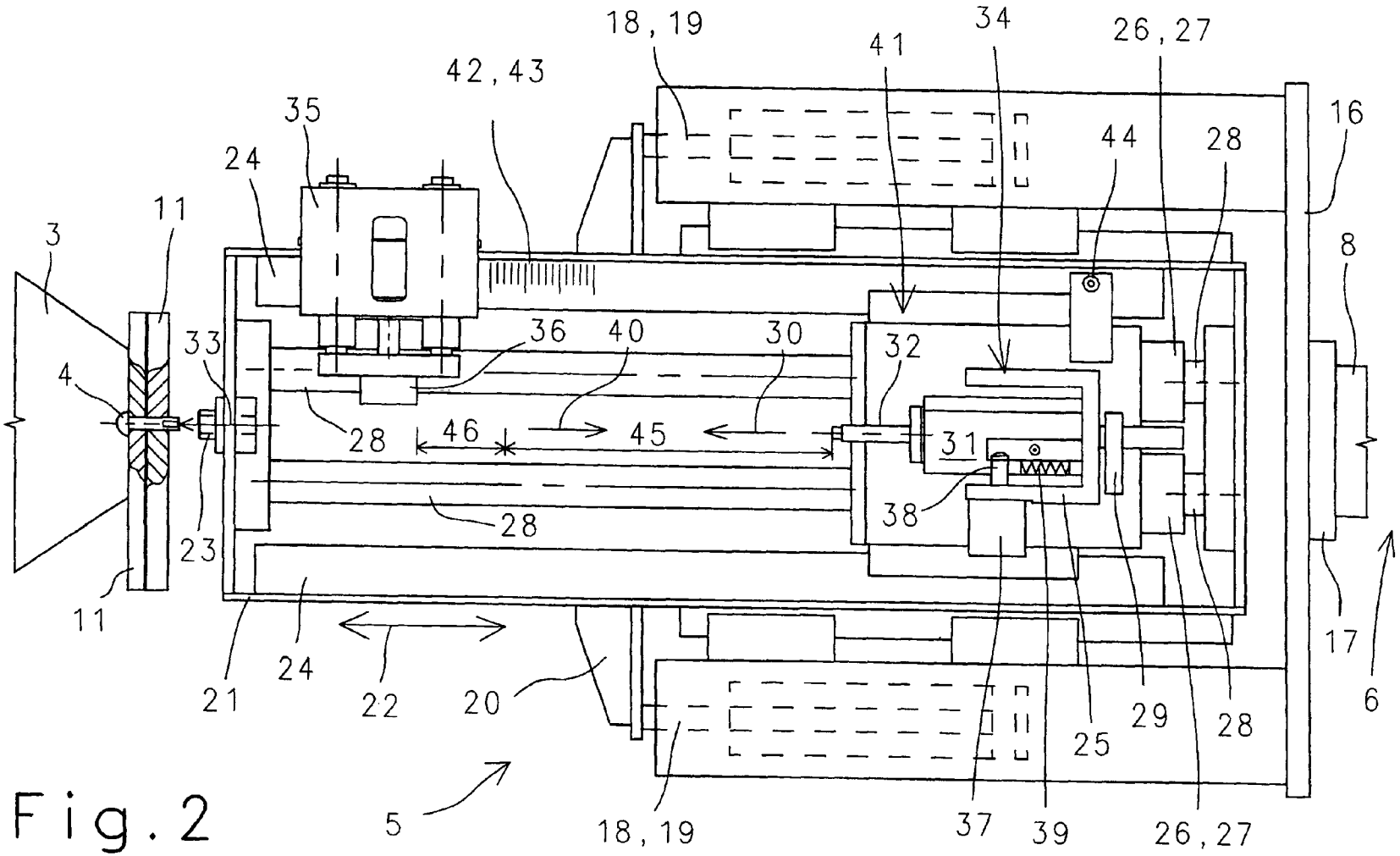
FIG. 2 is a detailed side view of the riveting adapter according to the invention.

According to FIG. 2 the riveting adapter 5 includes a supporting framework 16, which in the simplest case is connected in a non-rotatable manner with the adapter flange 17 of the front segment 8 of the appropriate working robot 6, so that the riveting adapter 5 can be guided by pivoting the individual segments 8 of the working robot 6 about the respective pivot axes 10 precisely in a working region of that working robot 6. Positioning means 19 constructed as pneumatic cylinders 18 are mounted non-rotatably on the supporting framework 16 of the riveting adapter 5 in its outer peripheral region. The ends of the piston rods extending from the pneumatic cylinders 18 are attached to an adjusting flange 20 attached to a movable framework 21. The movable framework 21 is mounted in the riveting adapter 5 so that it is movable relative to the supporting framework 16 in the horizontal directions 22 when the pneumatic cylinders 18 integrated in the supporting framework 16 are pressurized or depressurized. The front side of the movable framework 21 is penetrated by a so-called ram sleeve 23, which protrudes through the front side of the movable framework 21. The movable framework 21 can be guided on the rivet 4 protruding through the components 11 to be fastened together, when the pneumatic cylinders 18 on the supporting framework 16 are pressurized. Thus the front end of the ram sleeve 23 rests on the component 11 closest to it and the free end of the rivet 4 protrudes at least partially into the ram sleeve 23. At the same time the position of the rivet 4 is fixed within the components 11 to be fastened together. In various embodiments of the invention the described pneumatic cylinders 18 can be replaced by electrically driven linear motors, which are not described further here, for exact positioning of the movable framework 21.

A carriage 25 is horizontally movable on guide rails 24, which are arranged inside the movable framework 21. Moving means 27 is arranged to move the carriage 25 in the horizontal directions 22. Moving means 27 comprises electrically driven linear motors 26, which are mounted in the movable framework. Their stators 28 supporting and guiding the linear motors 26 extend under the carriage 25 along the movable framework 21 and are rigidly attached to it. The electrical adjusting motors 26 move along the stators 28 when they are activated. They move the carriage 25 of the riveting adapter 5 in the forward direction 30 to the ram sleeve 23 by means of a finger member 29 associated with them. The carriage 25 movable relative to the movable framework 21 carries at least one additional weight 31 and a ram 32 on its front end. The ram 32 is arranged on the carriage 25 so that it passes through the ram sleeve 23 when the carriage 25 executes a motion 22 in the forward direction 30 toward the ram sleeve 23 and strikes the end of the rivet 4 facing it. Energy stored in the ram 32 at the instant the ram 32 strikes the rivet 4, which is called the impact energy 33 in the following description, deforms the rivet 4 in such a manner that the end facing the ram 32 is spread out or bulges out and thus a firm attachment of the components 11 is attained by means of the rivet 4. In the illustrated embodiment according to the invention the carriage 25 movable relative to the movable framework 21, the additional weight 31 and the ram 32 together form a movable deforming device 34.

The movable framework 21 has a clamping device 35 on a front potion facing the components 11 to be fastened together, which has at least one stop 36, which limits the horizontal motions 22 of the movable deforming device 34 caused by the linear motors 26 and in the simplest case brakes the deforming device 34 after successful impact of the ram 32 on the rivet 4, so that recoil of the deforming device 34 and repeated contact with the rivet 4 is prevented. The deforming device 34 can be held pneumatically in the simplest case so that the additional weight 31 is drawn from it by producing a vacuum in the vicinity of the at least one stop. In other embodiments of the invention the clamping device 35 can be attached at another position, for example near the supporting framework 16. The braking action on the movable deforming device 34 can be increased still further by associating damping elements in a manner, which is not shown in the drawing, with the finger member 29, which absorb at least a part of the energy residing in the recoiling deforming device 34.

The movable deforming device 34 is guided back to its initial position for performing additional riveting processes by running the linear motors 26 to their initial positions. The linear motors 26 return the deforming device 34 in the return direction 40 to the region of the movable framework 21 that is remote from the ram sleeve 23 and engage the movable deforming device 34 by means of a return element 38 associated with a linear displacement element 37. The deforming device 34 is fixed in its initial position in the simplest case by a so-called spring-loaded clamping element 39. So that the impact energy 33 of the movable deforming device 34 is adjustable in a manner according to the invention, a so-called linear guide device 41 with integrated distance measuring means is associated with at least one guide rail 24 attached to the movable framework 21. These types of linear guide devices 41 are usually constructed so that the guide rails 24 carry them and they are associated with a displacement-measuring device 42, for example, in the form of an engraved ruler or scale. The linear guide device 41 monitors this ruler or scale 43 by means of a suitable sensor 44, so that the movable deforming device 34 can be exactly positioned by means of this arrangement including the ruler or scale 43.

According to fundamental physical principles the impact energy 33 of the ram 32 on the rivet 4 is determined by the mass of the deforming device 34, its acceleration and the available path over which it is accelerated. A first possibility for changing the impact energy 33 would be to use additional weights 31 of different mass. The higher the mass of the additional weight 31, the higher the impact energy 33. The exchange of the additional weights 31 however leads to considerable assembly effort. Also the impact energy range achievable in this manner is very limited, since usually the available space does not permit great flexibility for using different additional weights 31. It is considerably more effective to change the impact energy 33 by changing the acceleration of the movable deforming device 34 and the length of the path over which the movable deforming device 34 is accelerated. The impact energy 33 may be changed by changing the acceleration of the movable deforming device 34, which is achieved in a simple manner by changing the current supplied to the linear motors 26. A higher acceleration of the movable deforming device 34 produces greater or higher impact energy 33. Analogously the available path 45 for the acceleration can be varied. An increase in the path 45 over which the acceleration occurs leads similarly to greater impact energy 33. To avoid higher delaying forces acting on the linear motors 26 the linear motors 26 are braked along a delay path 46 within the riveting adapter 5 at the end of the path over which the movable deforming device 34 is accelerated, during which the movable structural element moves further toward the rivet 4. Next, after the deforming device contacts the rivet 4, the deforming device 34 is braked by the clamping device 35 in the above-described way.

So that the movable structural element 34 generates an impact energy 33 which continuously guarantees that a sufficiently energetic deformation of the rivet 4 takes place for fastening the structural components 11 with each other by a single impact of the ram 32 on the rivet 4, the change of the impact energy 33 must especially consider the properties of the components 11 to be connected, the properties of the rivet 4 and the position of the rivet adapter 5 in space. Material thickness and material-specific deformation properties, such as the elastic modulus, play a role regarding the deformability of the components 11 to be connected. Analogously the required deformation energy depends entirely essentially on the properties of the rivet 4. The geometric dimensions and material properties of the rivet 4 play a role here. Also the position of the riveting adapter 5 in space influences the impact energy 33, since the components of the gravity forces (G −Gx, +Gx) due to the movable deforming device 34 acting in the direction of the ram 32 are directed in or opposite to the motion direction of the deforming device 34 according to the position of the riveting adapter 5 according to FIG. 3. So that the instantaneous position of the riveting adapter 5 can be determined at least one position sensor 48 constructed in a known manner as an inclination sensor 47 is associated with the riveting adapter 5, which determines the deviation of the position of the riveting adapter 5 from a vertical orientation. In other embodiments of the invention, which have not been illustrated, the inclination sensor 47 can also be directly integrated on the front end of the segment 8, since the riveting adapter 5 is non-rotatably attached to the front end of the segment 8.

Figure 3:
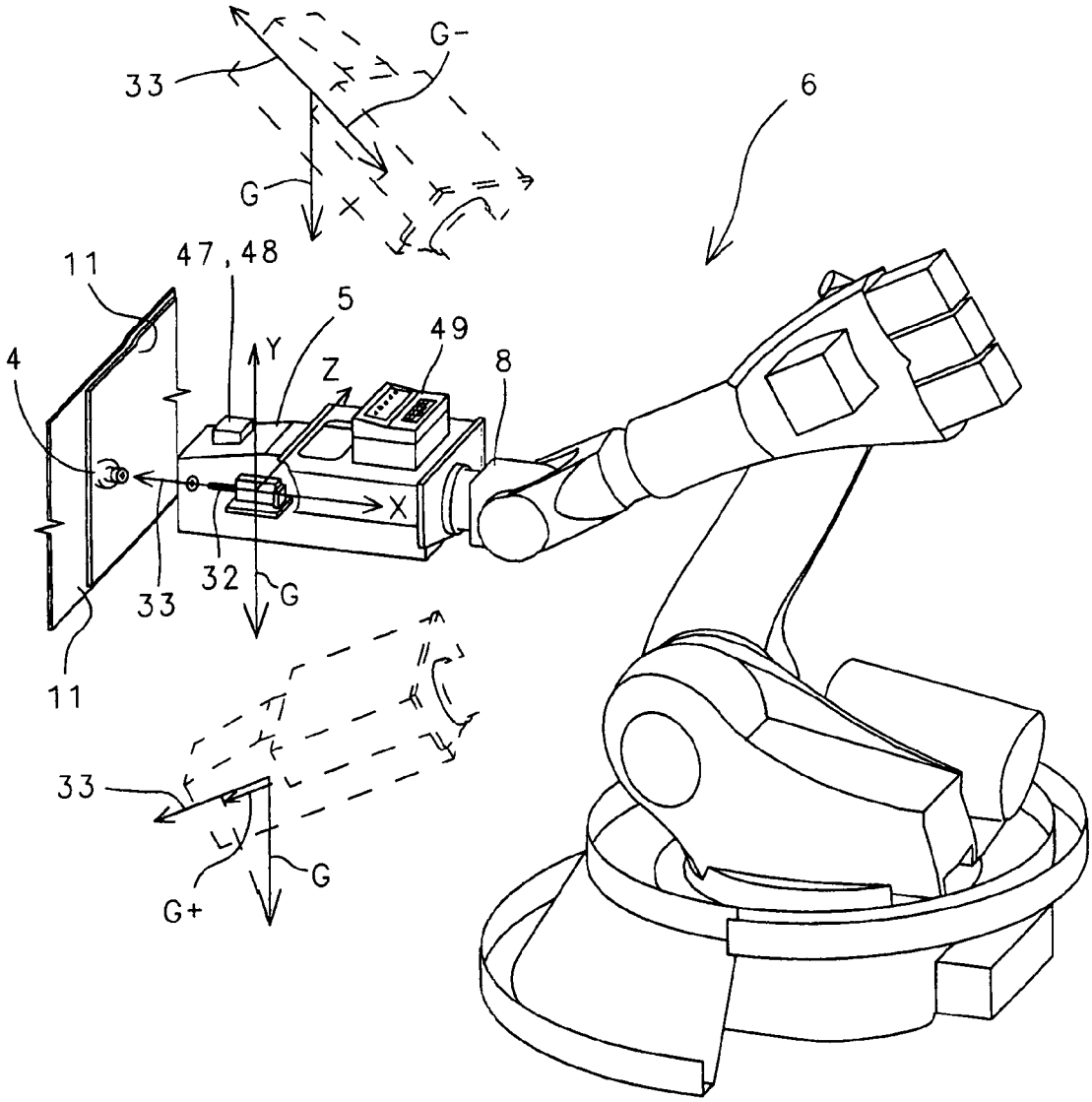
FIG. 3 is a perspective view showing the action of gravitational forces on the riveting adapter in different working positions.
Figure 4:
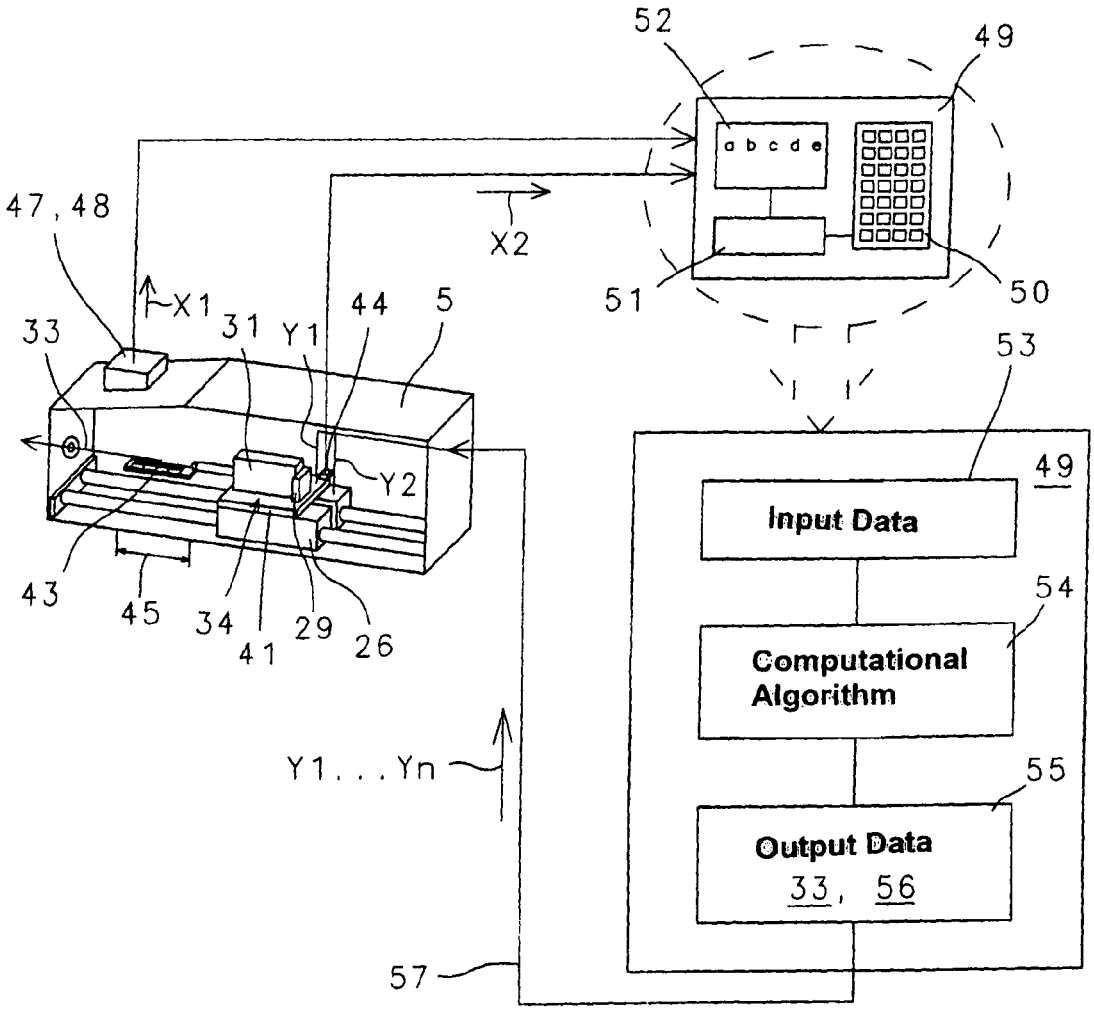
FIG. 4 is a diagrammatic view showing the determination of parameters in the riveting adapter according to the invention.

An electronic control and processing unit 49, which is described in more detail hereinbelow, is in working connection with the riveting adapter 5 according to FIG. 3 in operation, so that an optimization of the impact energy 33 is possible, wherein the impact energy 33 is immediately predetermined to be high enough so that connection of the components 11 by means of the rivet 4 to be deformed is possible by a single impact of the ram 32 of the riveting adapter 5 with the rivet 4, so that the mechanical load or stress on the riveting adapter and the working robot 6 carrying it and the noise emission is kept small. In various embodiments the control and processing unit 49 can be mounted, as shown, directly on the riveting adapter 5 or in any arbitrary position on the working robot 6. According to the embodiment shown in FIG. 4 the inclination sensor 47 determining the inclination of the riveting adapter 5 transmits the inclination signals X generated by it to the control and processing unit 49. Also an input device 50 is provided in the control and processing unit 49, by which the mass of the movable deforming device 34 and specific data regarding the rivet 4 and/or the components 11 to be connected can be input by the operator. The control and processing unit 49 also has a memory module 51, which can store various editable data input to the control and processing unit 49. So that the operator can monitor the running process, the control and processing unit 49 has a display monitor 52 for alphanumeric or graphical display of the various process data. Also a calculation algorithm 54 is input to the control and processing unit 49, which calculates output data 55 from input data 53 supplied to the control and processing unit 49. The input data 53 includes the mass of the movable structural element 34 and the specific data for the connecting element 4 and the components 11 to be connected. The output data 55 includes first optimized values for the required impact energy 33 and adjustment parameters 56 for different operating devices of the riveting adapter 5, which influence the impact energy 33. The adjustment parameters 56 include the length of the path 45 over which acceleration takes place, the acceleration of the movable deforming device 34 obtained by means of the linear motors 26 and if needed the required mass of the movable deforming device 34, which can be limited in the simplest case to the required mass of the additional weight 31. Finally the control and processing unit 49 transmits the output signals Y1 . . . Yn to appropriate operating organs of the riveting adapter 5 either by a wired data network 57 or a wireless network. In the simplest case the required length of the path 45 over which acceleration takes place can be adjusted so that the appropriate output signal Y1 is transmitted to the linear guide device 41 and it takes the exact position for the movable deforming device 34 path by means of the displacement measuring device 42, so that the determined path 45 of the acceleration of the structural element 34 can be traversed. Furthermore the acceleration signal coded in output signals Y can be transmitted to the linear motor 26. The acceleration of the linear motor 26 is determined from this acceleration signal Y2 in a control device, which is not illustrated in the drawing, associated with the linear motors 26. The control device transmits the appropriate acceleration to the movable structural element 34 by means of the finger member 29. In other embodiments of the invention a separate displacement measuring system 42, which has not been illustrated, can be associated with the linear motors 26 for precise positioning, which increases the flexibility and accuracy of the adjustment of the impact energy 33. Also advisory information can be displayed to the operator by means of the display monitor 52 so that the additional weight 31 integrated in the riveting adapter 5 can be replaced by an improved suitable additional weight 31 for reaching the required impact energy 33.

It is within the abilities of those skilled in the art to vary the structure of the described embodiments in undisclosed ways or to use other mechanical systems in order to attain the described effects within the scope of the present invention.

PARTS LIST

| | |
|---|---|
| 1 | Riveting station |
| 2 | Working robot |
| 3 | Positioning adapter |
| 4 | Rivet |
| 5 | Riveting adapter |
| 6 | Working robot |
| 7 | Segment |
| 8 | Segment |
| 9 | Pivot axis |
| 10 | Pivot axis |
| 11 | Structural component |
| 12 | Adapter unit |
| 13 | Tool |
| 14 | Hole |

-continued

PARTS LIST

| | |
|---|---|
| 15 | Rivet head |
| 16 | Supporting framework |
| 17 | Adapter flange |
| 18 | Pneumatic cylinder |
| 19 | Positioning means |
| 20 | Adjusting flange |
| 21 | Movable framework |
| 22 | Horizontal directions |
| 23 | Ram sleeve |
| 24 | Guide rails |
| 25 | Carriage |
| 26 | Linear motor |
| 27 | Moving means |
| 28 | Stator |
| 29 | Finger member |
| 30 | Forward direction |
| 31 | Additional weight |
| 32 | Ram |
| 33 | Impact energy |
| 34 | Deforming device |
| 35 | Clamping device |
| 36 | Stop |
| 37 | Linear displacement system |
| 38 | Return element |
| 39 | Spring-loaded clamping element |
| 40 | Return direction |
| 41 | Linear guide device |
| 42 | Displacement measuring system |
| 43 | Ruler or scale |
| 44 | Sensor |
| 45 | Acceleration path |
| 46 | Delay path |
| 47 | Inclination sensor |
| 48 | Position sensor |
| 49 | Control and processing unit |
| 50 | Data field |
| 51 | Memory module |
| 52 | Display monitor |
| 53 | Input data |
| 54 | Computational algorithm |
| 55 | Output data |
| 56 | Adjustment Parameter |
| 57 | Data line |
| X | Inclination signal |
| Y1 . . . Yn | Output signals |

The disclosure in German Patent Application DE 10 2004 005 859.8 on Feb. 5, 2004 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in an apparatus for fastening rivets in structural components, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. An apparatus for fixing rivets in structural parts, said apparatus comprising a positioning adapter (3) for fixing one end of a rivet in a structural component and for putting the rivet (4) in a riveting position; a riveting adapter (5) for deforming another end of the rivet, said riveting adapter having a movable deforming device (34) for deforming another end of the rivet by means of impact energy (33) stored in the deforming device (34); means for changing or adjusting the impact energy (33) of the movable deforming device (34), wherein said means for changing or adjusting said impact energy (33) includes means for changing an acceleration of the movable deforming device (34) and a length of a path (45) over which said movable deforming device (34) is accelerated.

2. The apparatus as defined in claim 1, wherein said riveting adapter (5) comprises a movable framework (21), said movable framework (21) has linear guide members (24) and said movable deforming device (34) is received or mounted on said linear guide members (24).

3. The apparatus as defined in claim 2, wherein said movable deforming device (34) is guided on both sides on respective linear guide members (24) and comprises a ram (32) on a front end thereof, said ram (32) comprising means for transmission of said impact energy (33) to said rivet (4).

4. The apparatus as defined in claim 3, wherein said movable deforming device (34) has a mass determined by mass of a linear guide device (41) and at least comprises a ram (32), an additional weight (31) and a movable carriage (25) carrying the additional weight (31) and the ram (32).

5. The apparatus as defined in claim 4, wherein said movable deforming device (34) has stop means (36) comprising a clamping device (35) for limiting a path over which said movable deforming device (34) is accelerated and for delaying said movable deforming device (34) after contact with the rivet (4).

6. The apparatus as defined in claim 5, wherein said movable deforming device (34) is delayed by pneumatic clamping of the additional weight (31) of the movable deforming device (34).

7. The apparatus as defined in claim 1, further comprising guide rails (24) and means (27) for moving the movable deforming device (34) along the guide rails (24) in opposite directions (30, 40).

8. The apparatus as defined in claim 7, wherein said means (27) for moving the movable deforming device (34) comprises electrically driven linear motors (26) with separate displacement measuring means (42).

9. The apparatus as defined in claim 1, wherein said movable deforming device (34) is associated with a displacement measuring means (42) and said displacement measuring means (42) is integrated in a linear guidance system.

10. The apparatus as defined in claim 9, wherein said linear guidance system comprises at least one guide rail (24) and said displacement measuring means (42) includes a ruler or scale (43) worked into the at least one guide rail (24).

11. The apparatus as defined in claim 10, wherein the linear guidance system includes a detector for monitoring the ruler or scale (43).

12. The apparatus as defined in claim 1, wherein said riveting adapter (5) comprises at least one position sensor (48).

13. The apparatus as defined in claim 12, wherein said at least one position sensor (48) is an orientation sensor or inclination sensor (47).

14. The apparatus as defined in claim 12, further comprising a control and processing unit (49) associated with the riveting adapter (5) and having means for storing editable data and means for receiving signals (X1, X2) generated by said at least one position sensor (47,48) and a displacement measuring system (42) as input signals (X), said editable data comprising a mass of the movable deforming device (34) and/or specific properties of the rivet (4) and/or components (11).

15. The apparatus as defined in claim 14, wherein said control and processing unit (49) contains at least one computational algorithm (54) for determination of required values of the impact energy (33) and wherein said at least one computational algorithm (54) receives input data (53) and said input data (53) comprises the mass of the movable deforming device (34) and/or the specific properties of the rivet (4) and/or components (11) and/or the input signals (X) of the at least one position sensor (47,48) and the displacement measuring system (42).

16. The apparatus as defined in claim 15, wherein said control and processing unit (49) determines output data (55) from said required values of the impact energy (33) and said output data (55) comprises a length of a path (45) over which the deforming device (34) is accelerated and acceleration of the deforming device (34) and the mass of the deforming device (34).

17. The apparatus as defined in claim 16, wherein said output data (55) are transmitted as output signals (Y1 . . . Yi) to said riveting adapter (5) and cause changes of said length of the path (45) over which the deforming device (34) is accelerated by moving the deforming device and in the acceleration of the deforming device (34) by means of linear motors (26) driving the deforming device (34).

18. The apparatus as defined in claim 17, wherein said control and processing unit (49) has a display monitor (52) for displaying the input signals (X), the output signals (Y) and adjusting parameters (56) for making said changes.

19. The apparatus as defined in claim 1, wherein the riveting adapter (5) is formed as an end effecter (8) of one or more working robots (6).

20. The apparatus as defined in claim 19, wherein the riveting adapter (5) has at least one positioning sensor (48) associated with said end effecter.

21. An apparatus for fixing rivets in structural parts, said apparatus comprising a positioning adapter (3) for fixing one end of a rivet in a structural component and for putting the rivet (4) in a riveting position; a riveting adapter (5) for deforming another end of the rivet, said riveting adapter having a movable deforming device (34) for deforming another end of the rivet by means of impact energy (33) stored in the deforming device (34); means for changing or adjusting the impact energy (33) of the movable deforming device (34), wherein said means for changing or adjusting said impact energy (33) includes means for changing an acceleration of the movable deforming device (34) and a length of a path (45) over which said movable deforming device (34) is accelerated, wherein said means for changing or adjusting said impact energy (33) adjusts said impact energy according to specific properties of components (11) to be fastened together and/or according to specific properties of said rivet (4) and/or a position of said riveting adapter (5) in space.

* * * * *